United States Patent [19]

Braund et al.

[11] 4,105,278

[45] Aug. 8, 1978

[54] MOLDED CABLE TERMINATION ASSEMBLY WITH INSERT

[75] Inventors: Kenneth William Braund, Newbury; John Lawrence Webster, Painesville, both of Ohio

[73] Assignee: A P Products Incorporated, Painesville, Ohio

[21] Appl. No.: 752,469

[22] Filed: Dec. 20, 1976

[51] Int. Cl.[2] ..... H01R 13/58

[52] U.S. Cl. ..... 339/103 M; 339/176 MF; 339/218 M

[58] Field of Search ..... 339/218 R, 218 M, 103 R, 339/103 C, 103 M, 103 B, 14 R, 17 E, 17 F, 147 P, 176 MF; 249/94, 97; 264/272

[56] References Cited

U.S. PATENT DOCUMENTS

| | | | |
|---|---|---|---|
| 475,920 | 5/1892 | Bassett | 174/122 C |
| 2,771,588 | 11/1956 | Schinske et al. | 339/218 R |
| 3,056,852 | 10/1962 | Sachs | 339/103 B |
| 3,105,871 | 10/1963 | Eager, Jr. | 174/110 PM |
| 3,399,372 | 8/1968 | Uberbacher | 339/14 R |
| 3,406,370 | 10/1968 | Gaw | 339/218 R |
| 3,737,833 | 6/1973 | Jerominek | 339/17 F |

FOREIGN PATENT DOCUMENTS

| | | | |
|---|---|---|---|
| 343,711 | 11/1921 | Fed. Rep. of Germany | 339/103 B |
| 410,099 | 10/1966 | Switzerland | 339/103 B |

*Primary Examiner*—Neil Abrams

*Attorney, Agent, or Firm*—Maky, Renner, Otto & Boisselle

[57] ABSTRACT

A molded cable termination assembly for terminating a woven cable, which has a fabric-like woven insulation about the conductors thereof, includes in one embodiment a pair of clamping pads tightly clamped against the woven cable during injectionmolding of a housing base directly to the cable to prevent wicking of the molding material along the cable exteriorly of the mold. In another embodiment, a lip seal arrangement securely grips the woven cable in response to the pressure exerted during the injection molding process to prevent such undesirable wicking. The latter embodiment also is effective to provide strain relief holding of the cable in the molded housing base and, therefore, enables molding a cable termination direction to non-bondable, non-wettable or like cables.

22 Claims, 5 Drawing Figures

MOLDED CABLE TERMINATION ASSEMBLY WITH INSERT

BACKGROUND OF THE INVENTION

The present invention relates generally, as indicated, to molded cable termination assemblies and, more particularly, to such assemblies that terminate woven or previously relatively unbondable types of cables.

Woven cables which are, of course, well known are particularly used for high speed signal transmission purposes. Such cables may be formed of one or more conductors within a woven nylon or other fiber dielectric material. Usually there are a plurality of such linearly spaced-apart conductors within the dielectric material with the over-all cable having a ribbon-like appearance, for example. These woven ribbon cables are relatively flexible to facilitate their usage in tightly packed areas.

In the past the common way to terminate one or more conductors of an electrical cable was to attach a cable termination device thereto. A cable termination device includes a plurality of electrical contacts individually connected to respective conductors of the cable and a housing mechanically holding the contacts and the conductors in a relatively fixed relation with the contacts also having an exposed area for electrical connection to an external device, such as another such termination, a socket on a computer terminal or the like. The assembled cable termination device and electrical cable are commonly referred to as a cable termination assembly.

In co-pending U.S. patent application Ser. No. 656,303, filed Feb. 9, 1976, for "Jumper Connector", now U.S. Pat. No. 4,030,799, which patent is assigned to the same assignee as the present application, a molded cable termination assembly is disclosed. In such assembly the supportive body or housing base of the cable termination device is actually molded directly about part of the contacts and cable to form an integral cable termination assembly. The advantages of such a molded cable termination assembly are described in such application.

In the past some cable termination assemblies for woven cables had the conductors of such cable attached to respective contacts and portions of the contacts and of the cable were potted. Typically, those contact and cable portion would be placed in a plastic housing or in a mold and the housing or mold would be filled with a potting material which would cure to a solid body holding those cable and contact portions in fixed spatial relation. A problem encountered during the potting procedure has been wicking of the relatively fluent uncured potting material along the woven cable beyond the entry point of the latter into the housing or mold because the woven insulation will not form a good seal directly with the relatively unflexible walls of the mold. After the wicked potting material in the cable outside the housing or mold had cured within and/or about the woven dielectric material, that material would become relatively brittle. As a result, a relatively slight flexing of the exposed brittle cable portion may cause the cable to break or to wear out prematurely. Alternatively, such flexing may cause failure of one or more of the conductor-contact connections within the potted body.

Moreover, in the past, the molding of a cable termination assembly to a cable comprised of conductors in a Teflon or like relatively non-bondable or non-wetting insulation material has been difficult and often impossible.

SUMMARY OF THE INVENTION

The invention provides a seal established at the area that an electrical cable enters the molded housing base of a cable termination assembly. In one form of the invention, the seal is a pressure-responsive mechanism that increases its sealing relation with the cable insulation under the influence of the relatively high pressure fluid-like material of which the housing base is formed during the molding process thereof in an injection molding machine. In this form of the invention the seal reduces the wicking of such fluid-like material along the cable insulation beyond the housing or the mold forming the same during the molding process. Moreover, the seal may be constructed to hold the cable very tightly to provide a strain relief function and in the case of a non-bondable, non-wettable-like insulation material, such as, for example, Teflon, provides the mechanical mechanism that secures the cable insulation in the molded housing as an integral structure.

In another embodiment, the seal is comprised of a pair of sealing pads that are tightly clamped against at least a portion of the cable insulation by the several parts of the mold in the injection molding machine to prevent wicking along the woven cable insulation outside the mold.

In both embodiments flexure of the cable relative to the housing base may be facilitated either by rounding the entrance of the pressure responsive seal or by the cushioning effect of the sealing pads. Accordingly, such relative flexure facilitates usage in close-packed environments, for example, without stressing the juncture of the cable and molded housing base.

With the foregoing in mind, it is a primary object of the invention to provide a molded cable termination assembly that is improved in the noted respects.

Another object is to reduce and/or to eliminate wicking of fluid-like material along a woven cable or the like during molding of a housing base or the like directly thereto.

An additional object is to secure an electrical cable having a relatively non-bondable, non-wettable-like electrical insulation in a cable termination assembly arrangement in which the housing base of such assembly is directly molded about at least part of the electrical cable and electrical terminating means for the conductors thereof.

A further object is to facilitate flexure of the cable relative to a housing base that is molded directly thereto.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawing setting forth in detail certain illustrative embodiments of the invention, these being indicative, however, of but several of the various ways in which the principles of the invention may be employed.

DESCRIPTION OF THE PREFERRED EMBODIMENTS

Figure 1:
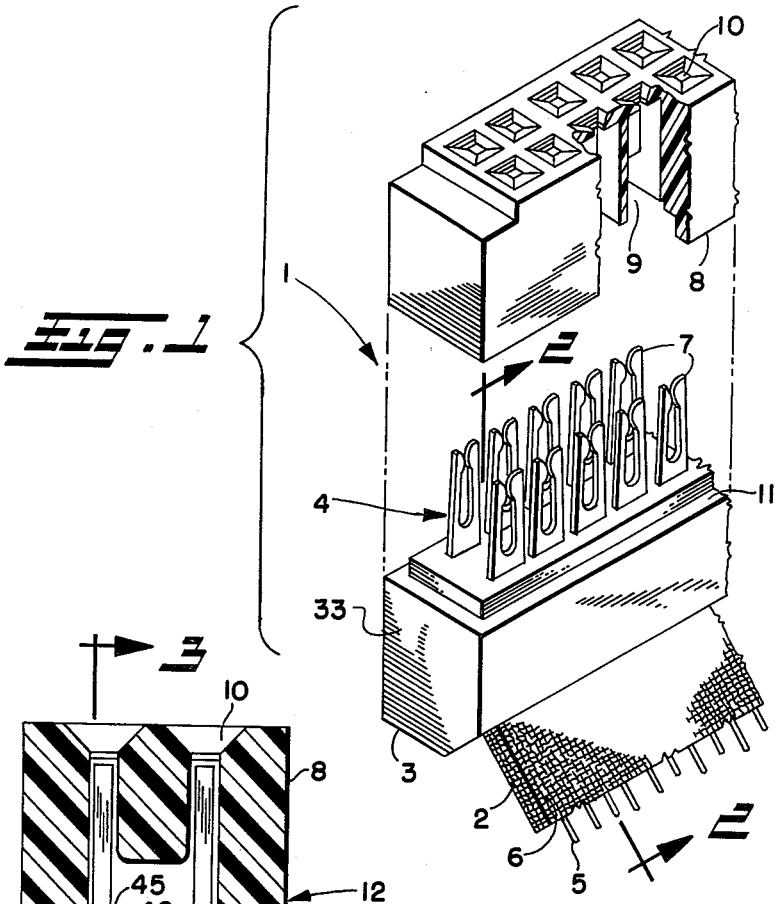
FIG. 1 is an exploded view illustrating a portion of a molded cable termination assembly in accordance with the invention.

Referring now more particularly to the drawing wherein like reference numerals designate like parts in the several figures, and initially to FIG. 1, a cable termination assembly in accordance with the invention is generally indicated at 1. The cable termination assembly 1 includes a multi-conductor electrical cable 2, a housing base 3 molded about and directly to a portion of the cable 2, and a plurality of electrical contacts generally indicated at 4 that terminate the respective conductors 5 of the cable. The housing base 3 also is molded about and directly to portions of the electrical contacts 4 to hold them in fixed spatial relation to each other and to the conductors 5. As illustrated, the cable 2 includes a woven electrical insulation 6, for example of fiberglass, nylon or the like, as is conventional, in which the respective conductors 5 are held in linearly spaced apart locations. Such a woven cable, which may be generally of ribbon-like shape, is relatively flexible and has been found especially suitable for simultaneously conducting therethrough a plurality of relatively high speed transmission signals.

The electrical contacts 4 have respective exposed ends 7 for connecting directly to respective contacts in a socket connector of a terminal board, in another cable termination assembly, or the like, not shown. As illustrated, the exposed contact ends 7 are of the female fork contact type; however, it will be appreciated that the exposed contact ends may be of other configuration, such as, for example, male pin contact type or other male or female type contacts, wiping contacts, etc. To facilitate guiding respective pin contacts to engagement with the electrical contacts 4, a dielectric cover 8 is placed over the exposed contact ends 7. The cover 8 has a plurality of chambers 9 that receive the respective exposed contact ends and a plurality of openings 10 that guide respective pin contacts directly to engagement with respective electrical contacts 4. The dielectric cover 8 may be secured to the housing base 3 at a step 11 in the latter, for example, by ultrasonic welding, adhesive material, or the like to complete the housing 12 of the cable termination assembly 1.

Figure 2:
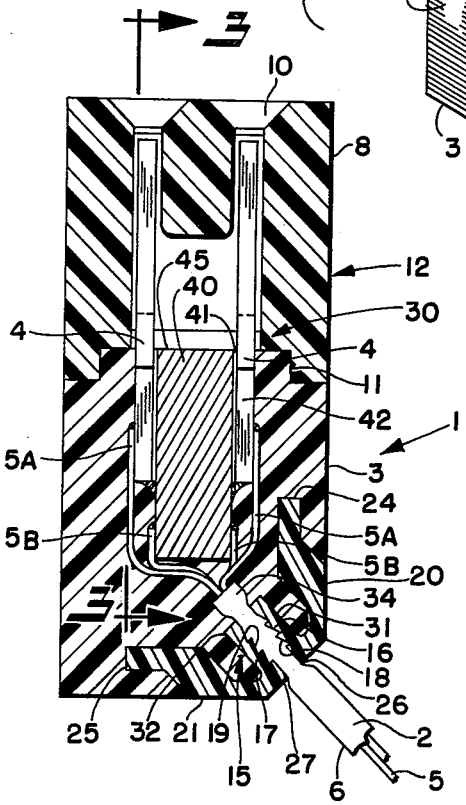
FIG. 2 is a section view of the molded cable termination assembly of FIG. 1 with the housing cover in place and looking generally in the direction of the arrows 2—2 of FIG. 1.
Figure 4:
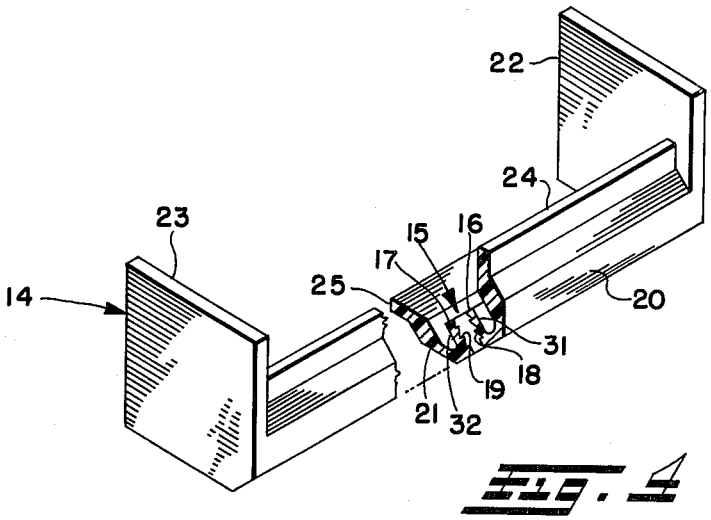
FIG. 4 is an isometric view, partially broken away in section, of a lip seal used in the molded cable termination assembly of FIG. 2, for example.

Turning now particularly to FIG. 2, a sealing mechanism in accordance with one embodiment of the invention is generally indicated at 14 molded into the lower right-hand quadrant of the housing base 3 as illustrated in the figure. The sealing mechanism 14, which is also shown in an isometric view in FIG. 4, preferably is in the form of a lip seal 15 defined by a pair of lips or lip-like walls 16, 17 between which the cable 2 passes. Ordinarily the spacing between the generally linearly extending walls of which the lips 16, 17 are formed is such that they will engage the cable insulation 6 when the cable is threaded therebetween.

Moreover, the lip seal walls 16, 17 have opposed serrated-like faces 18, 19 that bear against the cable insulation 6 to resist removal thereof from the lip seal 15. Walls 20, 21 which are held in relatively fixed relation by end wall plates or faces 22, 23 support the lips 16, 17 of the lip seal and form an integral structure. The walls 20, 21 have off-set flange portions 24, 25 that are embedded in the housing base 3, as can be seen most clearly in FIG. 2. Moreover, the bottom edges 26, 27 of the respective lips 16, 17 where they join the respective walls 20, 21 at the entrance of the cable through the lip seal 15 to the molded housing base 3 preferably are rounded to facilitate bending or flexure of the cable 2 relative to the housing base 3.

The cable 2 ordinarily is threaded through the lip seal 15 between the lips 16, 17, and the respective conductors 5 are terminated by a terminating mechanism generally indicated at 30 in a manner to be described further below. With the cable 2, sealing mechanism 14 and terminating mechanism thus assembled, the housing base 3 is then molded directly thereto. Preferably such molding is performed under elevated pressure, for example, as an injection molding process, so that the forces due to that pressure act against the back faces 31, 32 of the lips 16, 17 and urge the latter relatively tightly against the cable insulation 6 forming a seal therewith to impede wicking of the fluid-like molding material along the cable beyond the seal.

More specifically, the sealing mechanism 14 with the cable 2 threaded therein generally in the manner illustrated in FIG. 2 and the terminating mechanism 30 are placed in the mold of an injection molding machine. The end plates 22, 23 of the sealing mechanism facilitate positioning of the latter in the mold with the cable 2 extending out through an opening in the mold, for example, between two separable parts thereof. The walls 20, 21 rest against the faces of those mold parts, not shown, and under pressure during the molding process seal against those faces to stop leakage therebetween. Liquid-like molding material, which is usually at a temperature and a pressure that are elevated with respect to ambient, is injected into the mold and is allowed to cure therein to form the solid housing base 3. Thus, the terminating mechanism 30, the sealing mechanism 14, and the cable 2 are integrally incorporated as part of the housing base 3. The flange portions 24, 25 are embedded within the housing base 3 assuring that the sealing mechanism 14 is securely held as an integral part thereof, and the end plates 22, 23 also may be embedded within the housing base 3 or, alternatively, may form part of the respective side walls of the housing base, such as the side wall 33 shown in FIG. 1.

Preferably the spacing between the lips 16, 17 and the longitudinal length of the lip seal 15, i.e. in a direction between the end plates 22, 23, are such that at the start of the injection molding process the flow of fluid between the lip seal and the cable and the wicking along the cable are initially impeded. The pressure of the fluid-like material injected into the mold acting on the lip seal faces 31, 32 further increases the effectiveness of the seal. As a result, the amount of fluid-like material that reaches the portion of the cable 2 outside the lip seal 15 and the subsequently cured housing base 3 will be substantially reduced or completely eliminated. Therefore, after the fluid-like material has cured to form the solid body of the housing base 3, the cable 2 will remain relatively flexible at its point of entry into the cable termination assembly adjacent the edges 26, 27 of the sealing mechanism 15.

The fluid-like material employed during the just described injection molding process to form the housing base 3 is a conventional electrically non-conductive material, such as, for example, polyester material or the like, commonly used in injection molding electrical connectors. The sealing mechanism 14 may be formed of nylon material, for example, or other material that will not melt or substantially weaken at the temperatures ordinarily achieved during the injection molding process. The lips 16, 17 should have some degree of flexibility so they can increase the force with which they bind or press against the cable insulation 6 in response to the pressure of the fluid-like material during the injection molding process.

As was mentioned above, the walls 18, 19 of the lips 16, 17 may be serrated or similarly formed so that they effectively bite into the cable insulation 6 to hold the cable 2 securely in the housing base 3 of the cable termination assembly 1. In the case of a cable termination assembly 1 for a cable 2 of which the insulation 6 is of the woven type, the fluid-like material ordinarily permeates the woven insulation at the exposed end 34 thereof inside the housing base to secure the cable therein after curing, and the serrated walls provide an additional strain relief function to secure the cable and the molded material of the housing base 3 as an integral structure while preventing stresses at the junctures between the conductors 5 and the terminating mechanism 30. The serrated walls 18, 19 of the lips 16, 17 may provide a similar strain relief function in the case where the cable insulation is of the type that actually would chemically bond with the material of which the housing base 3 is formed during injection molding thereof. In this latter case the lip seal 15 also impedes leakage of fluid-like material along the cable outside the mold during the molding process.

Moreover, in the event that the cable insulation 6 is of the type that does not chemically bond with the fluid-like material of which the housing base 3 is formed during the injection molding process and is not of the woven type such that the fluid-like material would permeate the exposed fibers thereof to form a mechanical lock thereto, the biting action of the serrated walls 18, 19 of the lips 16, 17 may provide adequate strain relief retention to secure the cable 2 in the molded housing base 3. Accordingly, the sealing mechanism 14 with the gripping action provided by the serrated or similarly formed walls 18, 19 of the lips 16, 17 enable a housing base or the like to be molded directly to such an electrical cable, for example of Teflon or other insulation material that is non-bondable, non-wettable and the like at the pressures and temperatures used for injection molding. The resulting product is a cable termination assembly directly molded to and including part of such cable.

Figure 3:
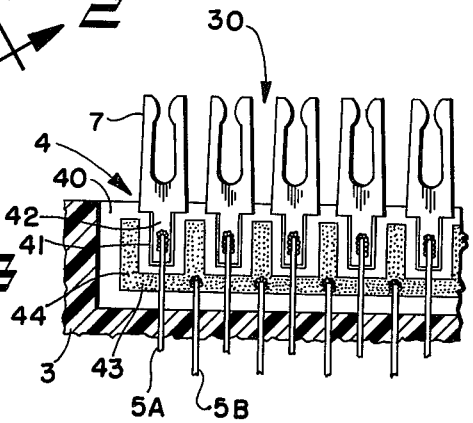
FIG. 3 is a partial section view to show the cable conductors terminating mechanism looking generally in the direction of the arrows 3—3 of FIG. 2 but with the housing cover removed.

Referring briefly to FIG. 3, the terminating mechanism 30 is shown in detail including a printed circuit board 40 on each surface of which a plurality of electrically conductive contact pads or pad-like traces 41 are formed at electrically isolated, spaced-apart locations. Each of the electrical contacts 4 has an attaching portion 42 that is soldered or otherwise connected to respective pads 41, and respective conductors 5A of the cable 2 also are similarly attached to respective contact attaching portions. A ground plane trace 43 that has a plurality of fingers 44 extending between, but electrically isolated from, the respective pads 41 is formed on the board 40 for conventional purposes. One or more of the conductors 5B of the electrical cable 2 is soldered to the ground plane 43, and a remote end of such conductors, not shown, may be coupled to a circuit ground. Preferably the printed circuit board 40, traces thereon, and contacts 4 attached thereto of the terminating mechanism 30 effectively provide a dual-in-line connecting arrangement, although other terminating patterns, for example using only one side of the board 40, may be employed. Of course, the terminating mechanism 30 illustrated is only one example of a typical terminating mechanism for a multi-conductor electrical cable, and it will be appreciated that other types of terminating mechanisms may be employed. If desired, an edge 45 of the printed circuit board 40 may be exposed to form part of one wall of the housing base, as illustrated in FIG. 2, or the printed circuit board may be fully embedded in the molded housing base.

Figure 5:
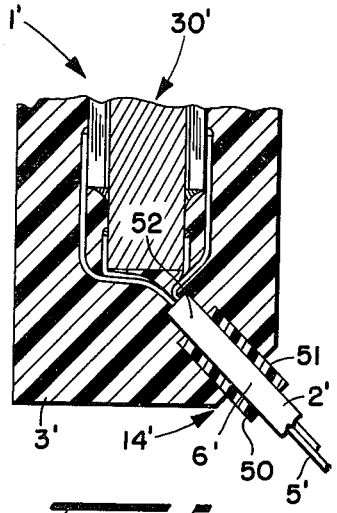
FIG. 5 is a section view similar to that of FIG. 2 showing an alternate embodiment of the invention employing a pair of sealing pads.

Turning now to FIG. 5, wherein primed reference numerals designate parts similar to those described above with reference to FIGS. 1 through 4, a modified form of cable termination assembly 1′ is generally illustrated. The assembly 1′ also includes a multiconductor electrical cable 2′, a molded housing base 3′, and a terminating mechanism 30′ for electrically terminating the respective conductors 5′ of the cable. The sealing mechanism 14′ of the termination assembly 1′ is established by a pair of pads 50, 51 that are preferably relatively more pliable or cushion-like than the material of which the cable insulation 6′ is formed. The pads 50, 51 are clamped against the cable 2′ in the mold of the injection molding machine. Preferably, the pads are of a size such that they overlie both sides of the surface width of the cable, and the clamping force with which the mold parts shut off against the pads and with which the latter are forced against the cable preferably is sufficient to prevent any wicking of the fluid-like material along the woven insulation 6′ during injection molding or other pressure-type molding of the housing base 3′.

The relatively pliable pad material preferably conforms somewhat to the irregular surface of the insulation to enhance the effectiveness of the seal therebetween.

The molding material ordinarily would permeate the exposed interior end 52 of the woven insulation 6′ to form a secure bond therewith holding the cable directly as an integral part of the housing base. Alternatively, in the event that the insulation 6′ is of the type that bonds chemically with the material of which the housing base 3′ is formed during the injection molding thereof, such a chemical bond would be formed so that the exposed end 52 of the insulation 6′ becomes an integral part of the housing base 3′.

Those portions of the pads 50, 51 that are exposed externally of the housing base 3′ and against which the clamping pressure of the mold cavity is applied may be broken away, if desired, after the housing base has cured or solidified. The remaining portions of the pads are integral then with the molded housing base and the relatively pliable nature of the pads may facilitate flexure of the cable outside the housing base relative to the latter.

In both embodiments the fluid-like material preferably fills voids in the mold during injection molding of the housing base. Thus, the areas at which the conductors 5 and contacts 4 and/or printed electrically conductive traces are joined preferably are encased in the molded housing base to form an integral structure. Further, the housing base may be molded under such elevated temperature and pressure conditions that the junctures of the respective conductors, electrical contacts, and/or printed traces are substantially free of moisture and oxygen so that those parts may be of dissimilar metals without encountering corrosion or other electrolytic-like detrimental effects.

The embodiments of the invention in which an exclusive property or privilege is claimed are defined as follows:

1. A molded cable termination assembly, comprising
an electrical cable including a plurality of electrical conductor means for conducting electric energy and woven electrical insulation,
electrical terminating means for terminating said electrical conductor means,
housing base means molded under pressure conditions directly and integrally to and about at least part of said cable, including at least part of said conductor means and woven electrical insulation, and said electrical terminating means for firmly holding the same in relatively fixed relation, and
seal means positioned directly between at least part of said woven insulating means and part of said housing base means for impeding wicking of fluid-like material along said woven electrical insulation externally of said housing base means during molding thereof thereby to maintain the relative flexibility of said cable externally adjacent said housing base means, said seal means including means for bearing against said woven electrical insulation with a force that increases in response to such pressure during molding of said housing base means to develop a pressure seal to impede any such wicking.

2. The assembly of claim 1, wherein said housing base means is injection molded directly and integrally to and about at least part of said cable and said electrical terminating means.

3. The assembly of claim 1, wherein said seal means comprises cushioning means urged securely against said woven electrical insulation.

4. The assembly of claim 3, wherein said electrical cable is generally of ribbon-like shape and said plurality of electrical conductor means comprises a plurality of electrical conductors, said electrical terminating means comprises a plurality of electrical contacts coupled to respective electrical conductors, and said cushion means comprises pad-like members on both sides of said ribbon-like shape electrical cable.

5. The assembly of claim 1, wherein said seal means comprises a lip seal.

6. The assembly of claim 5, wherein said electrical cable is generally of ribbon-like shape, said plurality of electrical conductor means comprises a plurality of electrical conductors, and said electrical terminating means comprises a plurality of electrical contacts electrically coupled to respective electrical conductors.

7. The assembly of claim 6, wherein said lip seal includes means for strain relief retaining said electrical cable in said molded housing base means.

8. The assembly of claim 5, wherein said lip seal includes a generally rounded portion at the external entrance thereof to said molded housing base means to facilitate flexure of said electrical cable relative to said housing base means.

9. The assembly of claim 1, wherein said electrical cable is generally of ribbon-like shape and said plurality of electrical conductor means comprises a plurality of electrical conductors.

10. The assembly of claim 9, wherein said electrical terminating means comprises a plurality of electrical contacts electrically coupled to respective electrical conductors.

11. The assembly of claim 10, wherein said electrical terminating means further comprises a printed circuit board having a plurality of contact pads thereon to which at least some of said electrical contacts are attached.

12. The assembly of claim 11, further comprising a ground plane on said printed circuit board separating respective contact pads.

13. The assembly of claim 12, wherein said printed circuit board has two surfaces with a plurality of contact pads and a ground plane on each of said surfaces.

14. The assembly of claim 11, wherein each of said electrical contacts includes a portion exposed beyond said housing base means for electrical connection to an external device and an attaching portion coupled to respective contact pads.

15. The assembly of claim 14, further comprising a cover over said exposed portions of said electrical contacts and opening means in said cover for guiding respective external devices to electrical connection with respective electrical contacts.

16. A molded cable termination assembly, comprising
an electrical cable including electrical conductor means for conducting electric energy and woven electrical insulation,
electrical terminating means for terminating said electrical conductor means,
housing base means molded directly about at least part of said cable and said electrical terminating means for firmly holding the same in relatively fixed relation to form an integral assembly, and
holding means positioned directly between at least part of said woven electrical insulation and part of said housing base means for holding said woven electrical insulation in said housing base means under the influence of pressure during molding thereof, said holding means comprising a lip seal including wall means facing each other and urged to bear against said woven electrical insulation with a force that increases in response to such pressure during such molding of said housing base means for holding positively the former relative to the latter as an integral structure.

17. The assembly of claim 16, wherein said wall means are stepped.

18. The assembly of claim 16, wherein said electrical conductor means comprises a plurality of electrical conductors.

19. The assembly of claim 18, wherein said electrical cable is generally of ribbon-like shape.

20. The assembly of claim 16, further comprising a curved portion at the external entrance of said lip seal to said housing base means to facilitate flexure of said electrical cable relative to said housing base means.

21. The assembly of claim 16, wherein said electrical insulation comprises a material that is non-bondable with said housing base means at the temperature and pressure at which the latter is molded.

22. The assembly of claim 21, wherein said electrical insulation comprises Teflon-like material.

* * * * *